US007264060B2

(12) United States Patent
Wills

(10) Patent No.: US 7,264,060 B2
(45) Date of Patent: Sep. 4, 2007

(54) SIDE ENTRY SUB HYDRAULIC WIRELINE CUTTER AND METHOD

(75) Inventor: Philip Wills, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 154 days.

(21) Appl. No.: 10/738,444

(22) Filed: Dec. 17, 2003

(65) Prior Publication Data

US 2005/0133227 A1 Jun. 23, 2005

(51) Int. Cl.
*E21B 29/04* (2006.01)

(52) U.S. Cl. ..... 166/376; 166/385; 166/54.5; 166/54.6; 166/242.5

(58) Field of Classification Search ..... 166/376, 166/54.5, 54.6, 242.5, 77.1, 385
See application file for complete search history.

(56) References Cited

U.S. PATENT DOCUMENTS

| | | | | |
|---|---|---|---|---|
| 2,794,619 | A * | 6/1957 | Lawrence et al. | 166/54.6 |
| 3,073,388 | A * | 1/1963 | Chenault | 166/54.5 |
| 4,388,969 | A | 6/1983 | Marshall et al. | |
| 4,603,578 | A | 8/1986 | Stoltz | |
| 4,660,635 | A * | 4/1987 | Wittrisch | 166/54.5 |
| 4,886,115 | A * | 12/1989 | Leggett et al. | 166/77.1 |
| 2002/0152856 | A1 | 10/2002 | Brumley et al. | |

* cited by examiner

*Primary Examiner*—Lanna Mai
*Assistant Examiner*—Matthew J. Smith
(74) *Attorney, Agent, or Firm*—Bracewell & Giuliani LLP

(57) ABSTRACT

A side entry sub for use with a drill string, where the side entry sub receives a wireline within its inner diameter. The present invention includes a device capable of severing the wireline proximate to the side entry sub. The present invention can further include a capturing device to grapple the severed portion of the wireline to prevent it from being dropped within the wellbore.

17 Claims, 4 Drawing Sheets

SIDE ENTRY SUB HYDRAULIC WIRELINE CUTTER AND METHOD

BACKGROUND OF THE INVENTION

1. Field of the Invention

The invention relates generally to the field of exploration and production of hydrocarbons from wellbores. More specifically, the present invention relates to a method and apparatus to operate tubing and pipe conveyed downhole tools within a wellbore. Yet even more specifically, the present invention relates to a method and apparatus to operate tubing and pipe conveyed downhole tools within a wellbore further including a wireline secured to the downhole tool. The apparatus and method of the present invention further relates to the ability to sever the wireline such that the severed portion above the incision can be removed from the wellbore in a relatively short amount of time.

2. Description of Related Art

One of the primary uses of the present invention occurs within a wellbore, therefore in describing the present invention, the terms "top" and "above" mean closer to the entrance of the wellbore, whereas the terms "bottom" and "below" mean further from the entrance of the wellbore and therefore closer to the bottom most portion of the wellbore. As illustrated in FIG. 1, downhole operations within a wellbore 5 can comprise a drill string 15 disposed within the wellbore 5 having a downhole tool 16 attached to the bottom end of the drill string 15. A wireline 10 can further be included that provides a way of transmitting data or commands between the downhole too 16 and the surface. The wireline 10 is generally connected to the downhole tool 16 via a cable head 12. To eliminate the time consuming task of threading the wireline 10 through each segment of the drill string 15, a known side entry sub 20 can be included with the drill string 15. Side entry subs 20 are typically integral with the drill string 15 and include an aperture (not shown) through which the wireline 10 can pass from inside of the drill string 15 to its outside. Once outside of the drill string 15, the wireline 10 extends up the wellbore 5 adjacent to the drill string 15 until it exits the wellbore 5. Outside of the wellbore 5 the wireline 10 is generally threaded through a series of sheaves 11 and onto a spool (not shown).

During some emergency situations it may be necessary to isolate the wellbore 5 by activating rams 8 that exist within a blow out preventer 7. As is well known, the pipe rams 8 extend out from the blow out preventer 7 and sealingly contact the outer circumference of the drill string 15 to produce a seal around the drill string 15 thereby isolating the wellbore 5 from the surface. Such emergency situations include gas kicks, blow out conditions, and any event that could cause the well to be out of control. The presence of the wireline 10 between the drill string 15 and the pipe rams 8 however prevents a sufficiently tight seal around the drill string 15 to adequately isolate the wellbore 5. Therefore, before the wellbore 5 can be isolated currently known methods require that the entire length of the wireline 10 be removed from the wellbore 5 before activating the pipe rams 8. Conventionally, when using a traditional prior art side entry sub 20 within a wellbore 5, in order to remove the wireline 10 an upward force is first applied on the wireline 10 to release it from the side entry sub 20. Then more tension is applied to the wireline to release the bottom connection 12 from the toolstring 16. However, since the downhole tool 16 is often thousands of feet below the entrance to the wellbore 5, and can be at depths exceeding 25,000 feet, there may not be sufficient time to extract the entire length of wireline 15 from the wellbore 5 before the well reaches an uncontrollable situation. Alternatively, in some deep and deviated wells it may be impossible to provide sufficient pulling force on the wireline 10 to release it from the toolstring 16. In addition, when using the side entry sub 20 during wireline fishing operations, a weakpoint in the tool string may not exist downhole. Thus the use of an alternative release mechanism at the side entry sub 20 is desired to reduce risks to an oil rig if an oil well cannot be controlled.

Thus in some extreme situations it may be necessary to activate the shear rams within a blow out preventer (not shown) to isolate the well before a blow out occurs. As is well known, shear rams can shear any object located within the annulus of the blow out preventer 7, including the drill string 15 and the wireline 10. Once the shear pipe rams have been activated, the toolstring 16, drillstring 15, and wireline 10, will probably be permanently lost downhole. This generally permanently damages the well such that it cannot be recovered. Any failure of the shear rams may also result in loss of a rig and significant risk to operational personnel at the wellsite. Therefore, there exists a need for the ability to quickly remove wireline 10 residing within a blow out preventer 7, where the wireline 10 hinders the use of the less destructive, pipe rams to isolate the well.

BRIEF SUMMARY OF THE INVENTION

The present invention includes a drill string for use in a wellborn operation comprising an elongated tubular member having a first end, a second end, an outer surface, and an inner surface. Also included with the present invention is an aperture radially formed through the tubular member thereby providing communication between the outer surface and the inner surface. Disposed within the drill string is a line cutting apparatus. A line is provided that extends through the aperture and down within the drill string. Also provided within said drill string is a slip in securing contact with the line. The line cutter can be a hydraulically actuated line cutter, a mechanically actuated cutter, or an electrically actuated cutter.

One embodiment of a line cutting apparatus of the present invention comprises an elongated housing having an outer surface and an inner surface, a rod disposed in the housing, a first piston slideably attached to the rod, and a cutting blade fixed on the rod. Axial displacement of the first piston along the rod urges the cutting blade toward the inner surface of the housing. Thus when a wireline is positioned between the cutting blade and the housing, the wireline can be severed by moving the first piston downward. Optionally a second piston is included that is also slideably attached to the rod. In an alternative embodiment, the second piston may be disposed radially around the first piston. Preferably a gap can be formed between the first and the second piston. The gap functions to fluid flow between the first and said second piston. A shoulder can be disposed on the rod to help separate the pistons and form the gap.

Optionally a ridge can be provided on the rod where the diameter of the second section is greater than the diameter of the first section. The ridge provides the capability of increasing the differential pressure across the first piston as the first piston passes across the ridge. Additional options include a fishing neck and a hanging plate disposed on the line cutting assembly. The hanging plate would provide one method by which the internal cutting assembly could easily be located with the pipe connection, to allow the wireline to be cut at the correct position. The fishing neck would allow the entire cutting assembly to be removed from the drillpipe, if at any time during the operation, it becomes necessary to gain access to the drillpipe, by passing logging tools down the drillpipe and below the side entry sub. In addition, the optional use of the extension arm and the wireline grapple would allow a severed wireline to immediately be caught by slips, to grapple the line.

The present invention can also include a method of performing wellbore operations comprising, inserting a drill string within a wellbore, connecting a downhole tool to a drill string, connecting a wireline to the downhole tool and threading it through the drill string, and integrating a side entry sub to a section of the drill string. The side entry sub comprises a housing having a first end, a second end, an outer surface, an inner surface, and an aperture radially formed through the housing thereby providing communication between the outer and the inner surface. The method further comprises threading the wireline through the aperture; and providing a cutting assembly within said drill string proximate to the side entry sub. Preferably the cutting assembly comprises a rod, a first piston slideably attached to the rod and a cutting blade fixed on the rod. Axial displacement of the first piston along the rod urges the cutting blade toward the surface of the housing proximate to the wireline. The method can also include activating the cutting assembly thereby severing the wireline as well as the additional step of removing the cutting assembly from the wellbore.

DETAILED DESCRIPTION OF THE INVENTION

Figure 2:
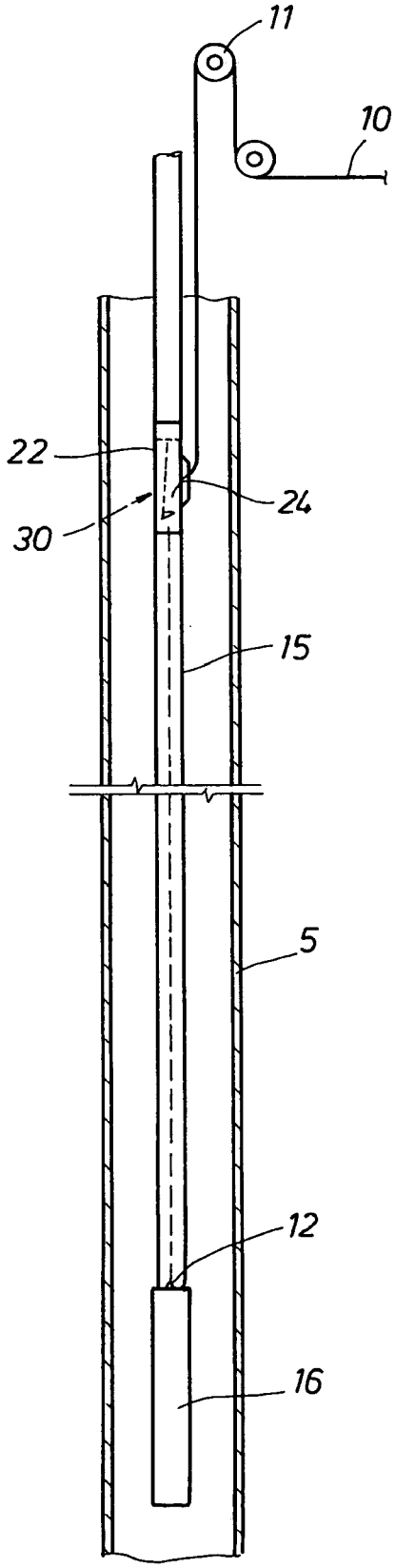
FIG. 2 illustrates one embodiment of the present invention within a wellbore.

With reference to the drawing herein, one embodiment of pipe string 15 having a side entry sub 22 with a cutter mechanism 30 is disclosed in FIG. 2. Here the pipe string 15 is disposed within a wellbore 5 and further includes a downhole tool 16 secured to one of its ends. The downhole tool 16 can be any one of a number of tools used in exploration or production of hydrocarbons within wellbores, such as perforating guns, well logging devices, or any other device used in combination with a pipe string in a wellbore. More specifically, the present invention is useful for downhole tools 16 that include the use of a wireline to perform their tasks.

As shown in FIG. 2 a wireline 10 is connected at the downhole tool 16 at a cable head 12, is disposed within the pipe string 15 from the cable head 12 up to the side entry sub 22, where it exits from the inside of the pipe string 15 through an aperture 24 formed in the wall of the side entry sub 22. The type and design of the side entry sub 22 considered for use with the present invention is not critical, but can include any currently known or later developed side entry sub. It is believed that it is well within the capabilities of those skilled in the art to either design or choose a suitable side entry sub. The preferred side entry sub for use with the present invention can be purchased from Texas Oil Tools, 2800 North Frazer, Conroe, Tex., 77303.

It is preferred that the side entry sub 22 of the present invention be located on the pipe string 15 at above the interval or range of depth within the wellbore 5 where downhole activities are to occur. For example, in the case of well logging, it is preferred that the side entry sub 22 be above the logging interval, likewise during perforating runs, the side entry sub 22 should be above the zonal depth where perforations are being made. As is well known, the position of the side entry sub 22 on the drill string 15 is set when the drill string 15 is assembled above the surface of the wellbore 5.

Figure 3:
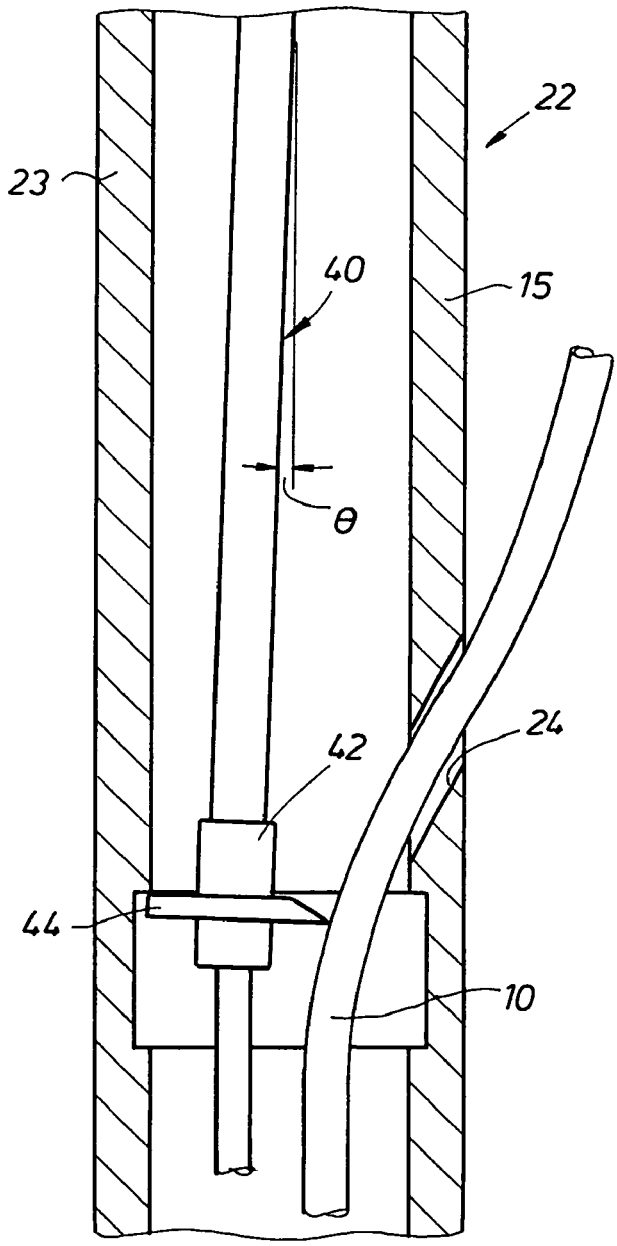
FIG. 3 depicts a cross sectional representation of one embodiment of the present invention in use within a wellbore.
Figure 4:
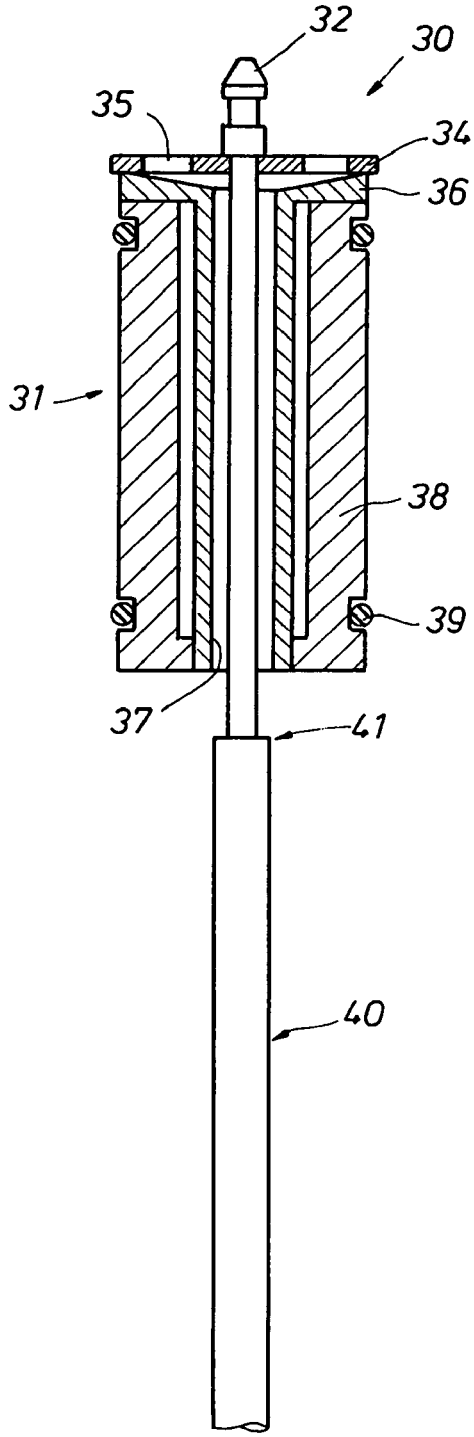
FIG. 4 illustrates a cross sectional view of one embodiment of the present invention.

FIGS. 3 and 4 illustrate one embodiment of a cutting assembly 30 of the present invention. The cutting assembly 30 comprises a cutting rod 40, a shoulder 42, a cutting blade 44, and a piston assembly 31 comprising an inner (first) piston 36 and an outer (second) piston 38. With reference now to FIG. 3, in which a partial cross sectional view of one portion of an embodiment of the side entry sub 22 of the present invention is provided. Here the wireline 10 can be seen passing into the drill string 15 through the aperture 24. Disposed adjacent to the wireline 15 is the cutter blade 44 suspended and supported by the cutter rod 40 on the lower end of the cutter rod 40. The sharpened end of the cutter blade 44 should be proximate to the wireline 10. In one form of the current invention, the cutter blade 44 will almost extend across the entire diameter, but may also be guided by a guide, runners, or the profile of the cutting blade itself.

Referring now to FIG. 3 it can be seen that to accommodate the wireline 10 within the housing 23 of the side entry sub 22, the cutter blade 44 resides up against the inside of the housing 23 opposite of where the wireline 10 passes through the housing 23. The top end of the cutter rod 40 should be substantially close to the center of the diameter of the housing 23. Accordingly, after the wireline 10 is threaded through the side entry sub 22, the cutter rod 40 resides in the housing 23 at an angle $\theta$ with respect to the axis of the housing 23.

In one form of the current invention, the upper end of the cutter rod 40 terminates on a hanging plate 34 (FIG. 4). The hanging plate 34 is provided to easily locate and secure the cutting assembly 30 within the side entry sub 22, however this hanging plate must include an auxiliary device to be able to release the cutter, when it is required to retrieve the cutter by pulling from above on fishing neck 32. The embodiment of the hanging plate 34 illustrated in FIG. 4 preferably includes a frangible connection, such as shear screws/shear pins, that provides a releasable connection. In one form, these shear screws could anchor the hanging plate to appropriate machined slots/recesses machined into the internal surface, right at the top of the cutter's drillpipe connection (shear screws are anchored in place once another joint of drillpipe is connected above the hanging plate). These frangible connections can be released using appropriate fishing equipment to jar on the fishing neck 32 to generate the required force to fracture and release shear screws and retrieve the entire cutting assembly 30 from the drill string 15. However the particular design of the hanging plate 34 is not critical to the spirit of the present invention as long as it releasably connects the cutting assembly 30 within the side entry sub 22 or the drill string 15.

Referring now to FIG. 4, one embodiment of the present arrangement is depicted in a cross sectional view illustrating the piston assembly 31 axially disposed on the outer radius of the cutter rod 40. The outer piston 38 is slidingly disposed on the inner piston 36 and is separatable from the inner piston 36. As shown in FIG. 4, the cutter rod 40 includes a ridge 41 where the diameter of the cutter rod 40 abruptly decreases. At the time the side entry sub 22 is attached to the drill string 15 and the wireline 10 threaded through the side entry sub 22, the piston assembly should be on the upper section of the cutter rod 40 above the ridge 41. It should be pointed out that when the piston assembly is on the cutter rod 40 as shown in FIG. 4, the cutting blade 44 should be disposed on one side of the housing 23 and adjacent the wireline 10 as displayed in FIG. 3. The diameter of the cutter rod 40 above the ridge 41 is preferably about one half the diameter of the cutter rod 40 below the ridge 41. When the piston assembly is above the ridge 41, spatial clearance exists between the outer diameter of the cutter rod 40 and the inner piston inner diameter 37. This clearance allows lateral movement of the cutter rod 40 within the inner piston 36 thereby enabling the cutter rod 40 to be situated in the angle θ depicted in FIG. 3. This gap further enables fluids to flow past the piston assembly 31 without creating excessive pressure loss, as it is sometimes necessary to pump fluid for extended periods to cool the logging tool 16. This is particularly true in high temperature wells where failure of a sensitive logging tool 16 will result if not cooled down by continuously pumping fluid from the surface.

As is well known in the art of tubing or pipe conveyed downhole operations, the wireline 5 is connected to the downhole tool 16 via a cable head 12. As the drill string 15 is assembled (or made up) a section at a time above the surface of the wellbore 5, the wireline 10 is threaded inside of each individual section of the drill string 15. As the drill string 15 is made up to the point where the side entry sub 22 is to be attached, the wireline 10 is threaded into the lower end of the side entry sub 22 and out of its aperture 24. As noted above, there is a certain location on the drill string 15 where the side entry sub 22 is to be located. Thus, the wireline 10 will be outside of the sections of the drill string 15 that are added to the drill string 15 after the inclusion of the side entry sub 22.

During typical downhole operations involving a pipe string 15 combined with a wireline 10, there is usually no reason to sever the wireline 10. As noted above however, the wireline 10 will sometimes need to be severed in order to properly seal around the drill string 15 and prevent a potential blow out condition. When such a need arises, the present invention can be used to sever the wireline 10 by increasing the pump rate at which fluid is pumped down the drillpipe, until the pump rate is sufficient to create the required differential pressure across the pistons assembly 31 causing the shear screws to shear thereby allowing the piston assembly 31 to accelerate down towards the cutting blade 44. As the piston assembly travels down the cutter rod 40 toward the cutter blade 44, the inner diameter 37 of the inner piston, that is substantially coaxial with the axis of the housing 23, moves the cutter rod 40 and aligns it to be substantially coaxial with the axis of the housing 23. Aligning the cutter rod 40 to the axis of the housing pushes the cutter blade 44 away from the opposing wall of the housing 23 and against the wireline 10. When sufficient force has been applied to the top of the piston assembly the downward movement of the piston assembly will in turn further cause the cutter blade 44 to impinge upon the wireline 10 until the wireline 10 is completely severed.

Figure 1:
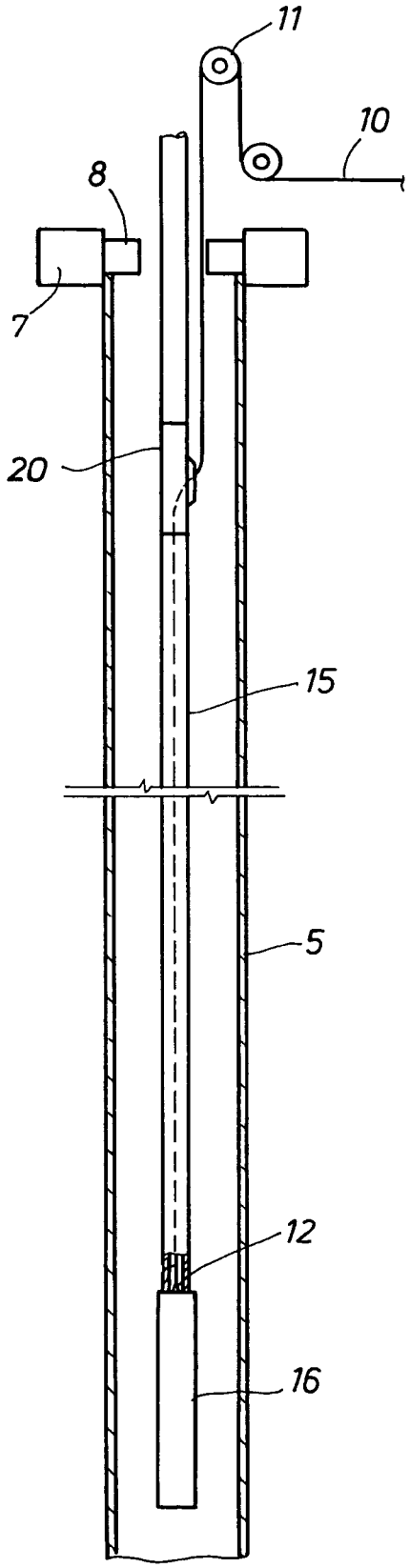
FIG.1 (PRIOR ART)
FIG. 1 depicts a prior art method of a drill string in combination with a side entry sub.

Once the wireline 10 has been severed, the portion of the wireline 10 above the cutter blade 44 can then be drawn up from within the wellbore 5 by first overpulling on the wireline to exceed the rating of the wireline clamp (not shown) within the side entry sub 22. As is well known, the wireline clamp releaseably secures the wireline 10 to the outside of the side entry sub 22. One of the many advantages of the present invention is that this portion of the wireline 10 can be quickly removed from between the drill string 15 and the pipe rams of the blow out preventer (FIGS. 1, 8). Since the cutting assembly 30 will be well above the downhole tool 16, the length of the wireline 10 that needs to be removed to clear the space between the pipe rams and the blow out preventer can be far less than the total length of the wireline 10. Without inclusion of the present invention, removal of the wireline 10 would require fracturing the wireline 10 at the cable head 12 and then drawing up the entire length of the wireline 10. Thus the time required to remove severed wireline 10 utilizing the present invention will be significantly lower than the time it will take to remove the entire length of the wireline 10. Accordingly, this time saved can protect a well from gas kicks, blow-outs, and other uncontrollable situations.

The piston assembly can be pushed down along the cutter rod 40 in any number of ways, however the preferred method is to apply hydraulic pressure to the top of the piston assembly. Preferably the hydraulic pressure is provided at the top of the piston assembly (piston top pressure) by pumps located on the surface. More specifically, nozzles (not shown) can be fitted within the piston assembly, preferably the inner piston 36, the number and configuration of nozzles can be utilized to obtain a certain pressure differential based on a desired activating flow rate. Optionally, o-rings 39 can be added on the outer circumference of the outer piston 38 to provide a hydraulic seal between the piston assembly and the inner circumference of the housing 23.

Further, since each specific application of the present invention will most likely involve different pressures and flow rates, the nozzle design should ensure that the expected pressures and flows do not trigger activation of the piston assembly during normal operation and before the wireline 10 is to be severed.

Optionally, shear screws (not shown) that frangibly secure the piston assembly to the hanging plate 34 can be included with the present invention. As is well known in the art, the shear screws can be designed to fracture when the hydraulic pressure on top of the piston assembly reaches an actuation pressure. Implementation of properly designed shear screws can provide added insurance that the cutting function of the present invention will not be activated prematurely, but instead the piston assembly will remain in its initial position connected to the hanging plate 34 until the actuation pressure is applied to the piston assembly.

The piston assembly will continue to be propelled downward in response to the application of actuation pressure applied to its top even after the wireline 10 is severed. With continued downward movement, the piston assembly 31 will contact the shoulder 42 that is disposed on the lower portion of the cutter rod 40. As previously pointed out the outer piston 38 is separatable from the inner piston 36 thus as the piston assembly 31 contacts the shoulder 42 thereby preventing further downward movement of the inner piston 36. Continued actuation pressured applied to the piston assembly 31 causes the outer piston 36 to separate from the inner piston 36 and be urged further downward until it contacts the upper side of the cutter blade 44. To ensure that the outer piston 38 separates from the inner piston 36 when the piston assembly 31 contacts the shoulder 42, the diameter of the shoulder 42 should not exceed the diameter of the inner piston 36.

One of the advantages of separating the outer piston 36 from the inner piston 36 is that a flow path 60 is created between these two pistons that enables fluids to flow through the side entry sub 22 after the wireline 10 has been severed. Creating the flow path between the pistons provides a way of relieving the hydraulic pressure produced to actuate the cutting assembly 30, thereby noticeably reducing the pressure within the wellbore 5. Monitoring the wellbore pressure to detect such a pressure drop can then provide an indication that the wireline 10 has been severed. Another advantage realized by the ability to flow wellbore fluids through the side entry sub 22 after severing the wireline 10 is the ability to provide those fluids deep within the wellbore 5. As can be appreciated by those skilled in the art, in some gas kick or potential blow out conditions, the ability to deliver fluids to the wellbore 5 can be critical in maintaining control of the well.

The presence of the ridge 41 on the cutter rod 40 causes the piston assembly 31 to accelerate as it travels past the ridge 41 that in turn helps to ensure separation of the outer piston 38 from the inner piston 36. Since the diameter of the cutter rod 40 is smaller above the ridge 41 than below it, the inner piston 36 experiences a larger effective cross sectional area on its lower end when the inner piston 36 is above the ridge 41. This in turn translates into a larger effective cross sectional area on the bottom of the piston assembly 31. Accordingly, when the piston assembly 31 moves onto the ridge 41 the effective cross sectional area of the bottom side of the piston assembly 31 decreases. As is well known, having a smaller effective cross sectional area on the bottom of the piston assembly 31 will increase the pressure differential across the piston assembly 31 and correspondingly increase the downward force. This increased downward force experienced by the piston assembly 31 as it passes past the ridge 41 will then accelerate the piston assembly 31 to an increased velocity. The increased velocity of the piston assembly 31 can work to ensure separation of the inner piston 36 from the outer piston 38 as the piston assembly 31 contacts the shoulder 42.

Figure 5:
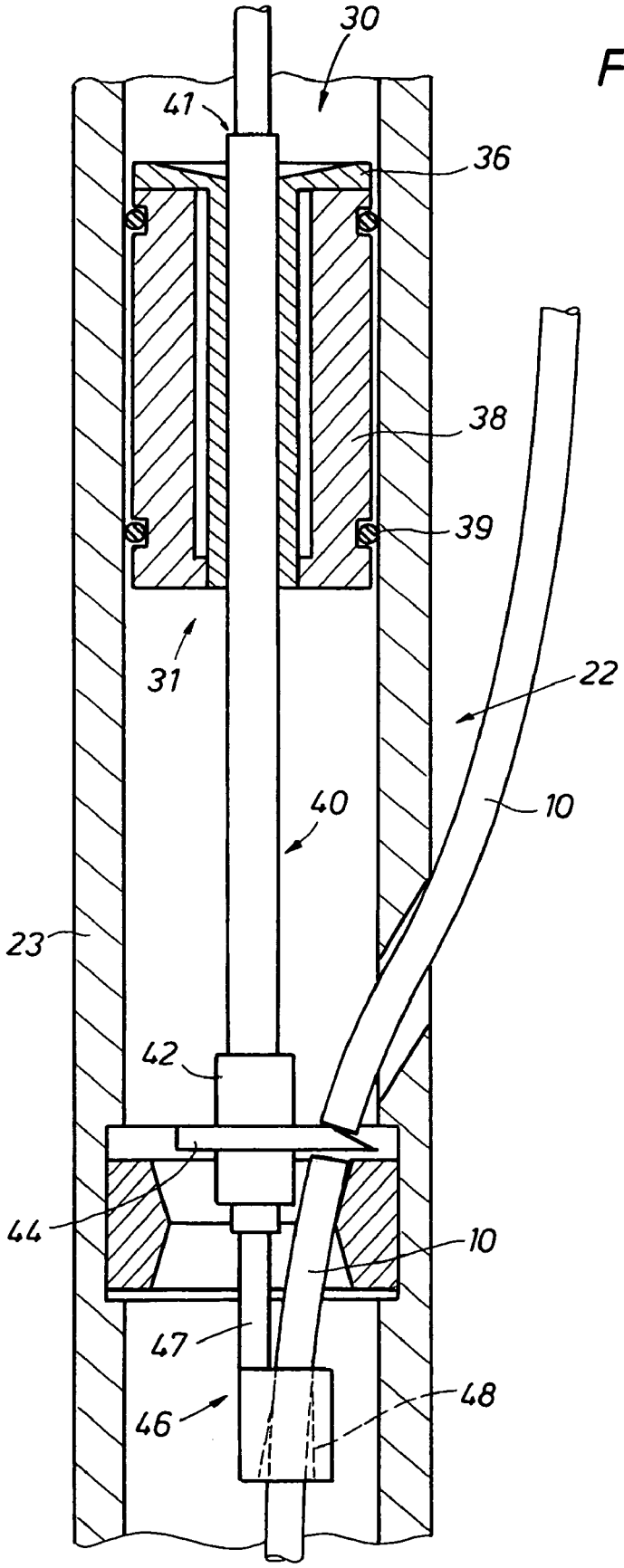
FIG. 5 illustrates a cross sectional view of one embodiment of the present invention.
Figure 6:
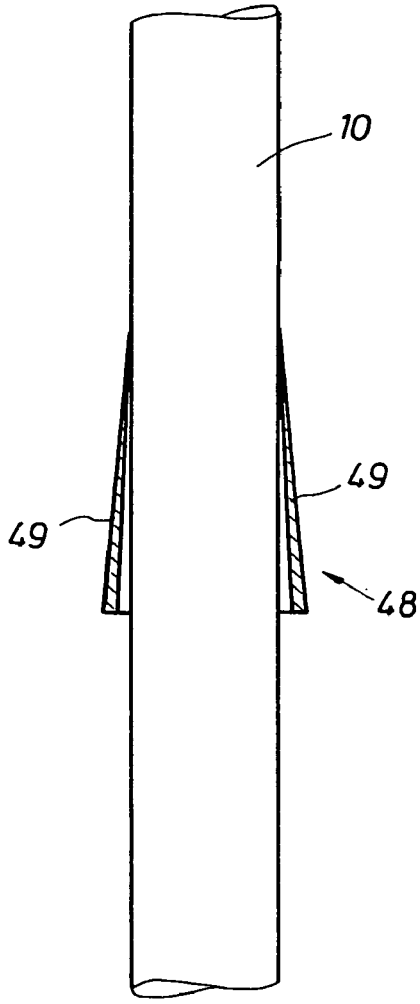
FIG. 6 illustrates a frontal view of one embodiment slips of the present invention.
Figure 7:
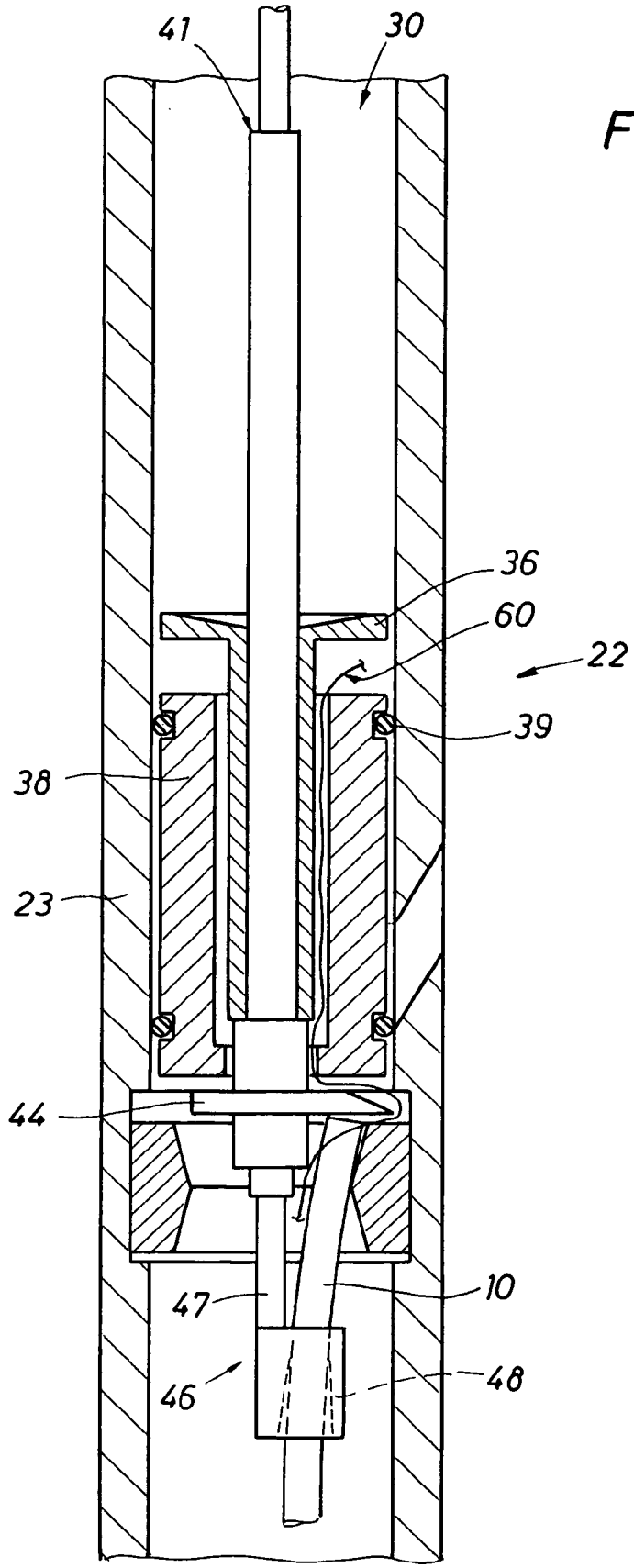
FIG. 7 illustrates a cross sectional view of one embodiment of the present invention.

Illustrated in FIG. 5 and downwardly projecting from the bottom of the cutter rod 40 is a wireline slip assembly 46. The wireline slip assembly 46 provides a way to capture the wireline 10 after it has been severed and prevent the portion of the wireline 10 below the side entry sub 22 from being left in the wellbore 5. The wireline slip assembly 46 comprises a wireline slip rod 47 that provides attachment to the remaining portion of the cutting assembly 40 and a wireline slip 48 that grasps the wireline 10 thereby securing it to the wireline slip assembly 46. Shown in FIG. 6 is a frontal view of one embodiment of the wireline slip 48 combined with a wireline 10. The wireline slip 48 preferably comprises at least two upwardly projecting prongs 49 that run at oblique angles to the wireline 10. The angle of the prongs 49 project away from the wireline 10 on their bottom end, but slidingly contact the wireline 10 on their respective upper ends. The obliquely angled prongs 49 thereby allow upward movement of the wireline 10 but when the wireline 10 starts to move downward the upward most point of the prongs 49 will impinge on the sides of the wireline 10 to resist downward travel of the wireline 10 thereby capturing the wireline 10 between the prongs 49. By capturing the wireline 10 with the prongs 49, the wireline 10 is thereby effectively secured to the remaining portion of the cutting assembly 30.

As previously discussed, the wireline 10 is severed to enable removal of the portion of the wireline 10 above the incision from the wellbore 10. Removing this portion allows a better seal around the drill string 15 at the entrance to the wellbore 10. After the wireline 10 is severed by the cutting assembly 30, it may be advantageous to remove the cutting assembly 30 as well. By including the wireline slip assembly 46 with the present invention, the remaining portion of wireline 10 can be removed from the wellbore 10 along with the cutting assembly 30. Many advantages can be realized by removing the cutting assembly 30 and the remaining wireline 10 from within the drill string 15—without also removing the drill string 15 as well. For example, a myriad of downhole operations can be conducted within the drill string 15 below the point where the cutting assembly 30 was located. The ability to conduct these operations may be critically important, for example in some instances the drillpipe may be stuck downhole. Releasing the drillpipe from below the side entry sub 22 can sometimes only be achieved by lowering tools from surface down through the inside of the drillpipe past the side entry sub 22 to a depth where the drillpipe is stuck. Therefore the ability to retrieve the cutting mechanism may be considered critical to the controlled recovery of the drillstring under certain conditions.

Therefore an optional fishing neck 32 is provided on top of the cutting assembly 30 to facilitate removal of the cutting assembly 30 with the attached wireline 10. It is believed that it is well within the capabilities of those skilled in the art to utilize any now known or later developed fishing tool remove the cutting assembly 30 from within the drill string 15. As noted above, the hanging plate 34 can provide a manner of attaching the cutting assembly 30 within the housing 23 or the drill string 15 itself. Thus when the cutting assembly 30 is being fished from within the wellbore 5, if frangible connections are used to secure the hanging plate 34 the force required to disconnect these connections should be taken into account. Further, in most instances the wireline 10 will be connected to the downhole tool 16 by a cable head 12, the force required to break that connection needs to be considered as well when removing the cutting assembly 30 from the wellbore 5.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the present invention can be implemented on wellbores that are land-based or that are sub-sea. Furthermore, the line considered for use with the present invention can include a slickline as well as a wireline. These and other similar modifications will readily suggest themselves to those skilled in the art, and are intended to be encompassed within the spirit of the present invention disclosed herein and the scope of the appended claims.

What is claimed is:

1. A cutting assembly for cutting a line comprising:

an elongated housing having an outer surface and an inner surface;

a first piston configured to coaxially move within the housing;

a cutting surface actuated by said first piston moveable into cutting contact with the line;

and a second piston configured to coaxially move in relation to said first piston and configured to coaxially move within the housing.

2. The cutting assembly of claim 1 further comprising a rod disposed in said housing.

3. The cutting assembly of claim 2 further comprising a shoulder disposed on said rod.

4. The cutting assembly of claim 1 further comprising a line disposed within said line cutting assembly.

5. The cutting assembly of claim 1 further comprising an aperture radially formed through said elongated housing thereby providing communication between said outer surface and said inner surface.

6. The cutting assembly of claim 1, wherein said cutting assembly is disposed within a pipe string.

7. A cutting assembly for cutting a line comprising:

an elongated housing having an outer surface and an inner surface;

a first piston within the housing;

a cutting surface actuated by said first piston moveable into cutting contact with the line;

a second piston slideably attached to said first piston;

a gap formable between said first piston and said second piston, said gap when formed capable of providing a fluid flow passage between said first piston and said second piston.

8. The cutting assembly of claim 7, further comprising a rod disposed in said housing and a shoulder disposed on said rod wherein said first and second piston are capable of slideably traveling along said rod proximate to one another and are separable upon contact with said shoulder.

9. The cutting assembly of claim 7, wherein said rod comprises a first section and a second section, wherein the diameter of said second section is greater than the diameter of said first section thereby increasing surface area for increasing the differential pressure across said first piston as the first piston passes from said first section to said second section.

10. The cutting assembly of claim 7 further comprising a slip in securing contact with said line.

11. A cutting assembly for cutting a line comprising:

an elongated housing having an outer surface and an inner surface;

a first piston within the housing;

a cutting surface actuated by said first piston moveable into cutting contact with the line; and a hanging plate frangibly coupled to said first piston.

12. A method of performing wellbore operations comprising:

connecting a side entry sub to a tubular member;

threading a line through the side entry sub;

threading the line through the tubular member; and providing a cutting assembly with said tubular member proximate to said side entry sub, where said cutting assembly comprises a first piston, and a cutting surface actuated by said first piston moveable into cutting contact with the line, wherein said cutting assembly further comprises a second piston slideably attached to said first piston.

13. The method of performing wellbore operations of claim 12 further comprising inserting a drill string within the wellbore and connecting the side entry sub to the drill string.

14. The method of performing wellbore operations of claim 12 further comprising connecting a downhole tool to the drill string, and connecting the line to the downhole tool.

15. The method of performing wellbore operations of claim 12 wherein said side entry sub comprises a housing having a first end, a second end, an outer surface, an inner surface, and an aperture radially formed through said tubular member thereby providing communication between said outer surface and said inner surface, said method further comprising threading the line through said aperture.

16. The method of performing wellbore operations of claim 12 wherein said cutting assembly further comprises a rod disposed in said housing.

17. The method of performing wellbore operations of claim 12 wherein said cutting assembly further comprises a gap formable between said first piston and said second piston, said gap when formed capable of providing a fluid flow passage between said first piston and said second piston.

* * * * *